US007146834B2

(12) United States Patent
Bull et al.

(10) Patent No.: US 7,146,834 B2
(45) Date of Patent: Dec. 12, 2006

(54) DEVICE FOR OPENING A LOCKED DOOR OR DRAWER

(75) Inventors: Philip William Bull, Newcastle-upon-Tyne (GB); George Robert Daintree, North Shields (GB)

(73) Assignee: Axis (NE) Limited (GB)

( * ) Notice: Subject to any disclaimer, the term of this patent is extended or adjusted under 35 U.S.C. 154(b) by 0 days.

(21) Appl. No.: 10/505,004

(22) PCT Filed: Feb. 20, 2003

(86) PCT No.: PCT/GB03/00749

§ 371 (c)(1),
(2), (4) Date: Aug. 18, 2004

(87) PCT Pub. No.: WO03/071059

PCT Pub. Date: Aug. 28, 2003

(65) Prior Publication Data

US 2005/0086986 A1 Apr. 28, 2005

(30) Foreign Application Priority Data

Feb. 20, 2002 (GB) ..... 0203935.2
Jul. 17, 2002 (GB) ..... 0216506.6
Dec. 3, 2002 (GB) ..... 0228174.9

(51) Int. Cl.
*E05B 15/08* (2006.01)

(52) U.S. Cl. ..... 70/454; 70/408; 292/336.3

(58) Field of Classification Search ..... 70/453–455, 70/408, 456 R; 292/336.3
See application file for complete search history.

(56) References Cited

U.S. PATENT DOCUMENTS

| | | | | | |
|---|---|---|---|---|---|
| 516,086 | A | * | 3/1894 | Easley | 70/454 |
| 1,217,798 | A | * | 2/1917 | Mahon | 70/454 |
| 1,389,380 | A | * | 8/1921 | Raab | 70/284 |
| 2,658,151 | A | * | 11/1953 | Heinz | 250/466.1 |
| 2,941,392 | A | * | 6/1960 | Byrne | 70/454 |
| 2,942,452 | A | * | 6/1960 | Marchese | 70/454 |
| 3,077,101 | A | * | 2/1963 | Jacobi | 70/455 |
| 3,874,204 | A | * | 4/1975 | Capri | 70/427 |
| 4,295,350 | A | * | 10/1981 | Grinage | 70/454 |
| 4,324,308 | A | * | 4/1982 | Clendenen | 180/315 |
| 4,638,652 | A | * | 1/1987 | Morse et al. | 70/454 |
| 4,821,542 | A | * | 4/1989 | Rosenthal | 70/454 |
| 4,910,983 | A | | 3/1990 | Taylor | |
| 5,029,916 | A | | 7/1991 | Chiu | |
| D334,880 | S | * | 4/1993 | Davey | D8/352 |
| D345,295 | S | * | 3/1994 | Davey | D8/352 |
| 5,452,927 | A | | 9/1995 | Uyeda | |
| 5,477,713 | A | * | 12/1995 | Lay | 70/454 |
| 5,495,641 | A | | 3/1996 | Going et al. | |
| 5,600,980 | A | * | 2/1997 | Fabian | 70/408 |
| 5,623,844 | A | * | 4/1997 | Draeger | 70/408 |
| 5,671,624 | A | | 9/1997 | Sivils | |
| 6,058,752 | A | | 5/2000 | Feder | |

FOREIGN PATENT DOCUMENTS

| | | |
|---|---|---|
| DE | 867208 | 2/1953 |
| GB | 2189834 | 11/1987 |
| GB | 2200396 | 8/1988 |

* cited by examiner

*Primary Examiner*—Suzanne Dino Barrett
(74) *Attorney, Agent, or Firm*—Anthony R. Barkume, P.C.

(57) ABSTRACT

A device for opening a locked door or drawer, which device comprises; a) means for facilitating the insertion of a key into a lock; and b) means for rotating said key when inserted.

12 Claims, 11 Drawing Sheets

DEVICE FOR OPENING A LOCKED DOOR OR DRAWER

This invention relates to a device for opening a locked door or drawer, and to a door or drawer fitted with a lock having such a device operatively associated therewith.

Most external doors are secured by a cylinder lock or a combination of a cylinder lock and a mortice lock.

One of the difficulties some people face, particularly those who are aging or who suffer with arthritis in their hands, is locating the key in the lock and then rotating the key once it is inserted therein. Such people also have difficulty operating the locks conventionally fitted to office and domestic furniture.

The present invention aims to mitigate these problems.

According to the present invention there is provided a device for opening a locked door or drawer, which device comprises;

a) means for facilitating the insertion of a key into a lock; and b) means for rotating said key when inserted.

Preferably, said means for facilitating the insertion of a key into said lock comprises a rotatable guide.

Advantageously, said rotatable guide comprises a slot for accommodating the shank of a key and facilitating the entry of said key into a lock.

Preferably, said rotatable guide comprises a concave cavity to facilitate the passage of a key to said slot.

Advantageously, said device includes means to bias said rotatable guide to a predetermined position.

Preferably, said means comprises a spring.

Advantageously, said device comprises a backing plate having an opening through which can pass the body of a cylinder latch but not the head thereof so that said device can be secured to a door via said cylinder latch.

Preferably, said device further comprises a cover removably mounted on said backing plate, and said rotatable guide is rotatably mounted between said backing plate and said cover.

Advantageously, said device includes a handle displaceable to rotate said rotatable guide.

Preferably, said handle has a recess to accommodate at least part of the head of a key when inserted in a lock.

In one embodiment, said handle comprises an elongate member which can be attached to said rotatable guide in two positions, one extending to one side of said rotatable guide and the other to the other side of said rotatable guide.

In another embodiment, said handle comprises a knob.

Preferably, said knob has a tortuous periphery to facilitate the gripping thereof.

In another embodiment, said handle is connected to said rotatable guide via a train of interacting wheels.

If desired, the device may include a spring loaded detent which acts (or reacts) on said rotatable guide to index said rotatable guide when said slot is in a predetermined position.

In a further embodiment, the device comprises a rotatable guide, and a frame pivotally mounted on said rotatable guide and pivotal, in use, between a hanging position and an operative, raised position in which it co-operates with a key so that when said frame is turned said rotatable guide and said key turn therewith.

In a further embodiment the device comprises a bush and a handle having a cylindrical section rotatably mountable in said bush.

Preferably, said cylindrical section and said handle are formed integrally.

Advantageously, said cylindrical section is provided with a groove which extends circumferentially thereof and which, in use, accommodates an edge of a backing plate to inhibit removal of said handle.

Preferably, a lug is provided in said groove which lug, in use, cooperates with said backing plate to limit rotational movement of said handle.

In a further embodiment, said means for rotating said key comprises a handle which is operably connected to said rotatable guide so that rotation of said handle will rotate said rotatable guide, and is movable towards and away from said rotatable guide.

Preferably, said rotatable guide is provided with a projection which extends outwardly from said rotatable guide, supports said handle, and defines a tapered cavity which, in use, facilitates the insertion of a key.

Advantageously, said device further comprising a backing plate.

Preferably, said backing plate is provided with an extension which extends rearwardly of the backing plate and is provided with a passageway of substantially constant keyhole cross section for allowing the passage therethrough of a key for a mortice lock.

Advantageously, said device further comprises a retaining cover, and one of said handle and said retaining cover is provided with a tongue and the other with a groove, alignment of said tongue with said groove ensuring alignment of said tapered cavity with said passageway to facilitate the insertion of a key.

The present invention also provides, a device in accordance with the present invention including a backing plate, and a spring which urges said handle away from said backing plate.

Preferable, said device further comprises a retaining cover, wherein said handle has a hub which projects through said retaining cover and is slidable relative thereto, and said device comprises a spring plate which is mounted on said hub and inhibits separation of said hub and said retaining cover.

Advantageously, one of said spring plate and said retaining cover has an upstand and the other a surface which, at least when said handle is urged into said retaining cover, engages said upstand, said surface having an indentation such that engagement of said upstand in said indent indexes said handle.

Preferable, said device includes means for inhibiting removal of a key from a lock.

In one embodiment said means comprises an arm moveable from an inoperative position in which a key may be freely inserted into or withdrawn and an operative position in which removal of said key is inhibited, and means to move said arm between its operative and inoperative positions.

The present invention also provides a door fitted with a lock having a device in accordance with the present invention operatively associated therewith.

The present invention also provides a drawer fitted with a lock having a device in accordance with the present invention operatively associated therewith.

For a better understanding of the present invention reference will now be made, by way of example, to the accompanying drawings, in which.

Figure 1:
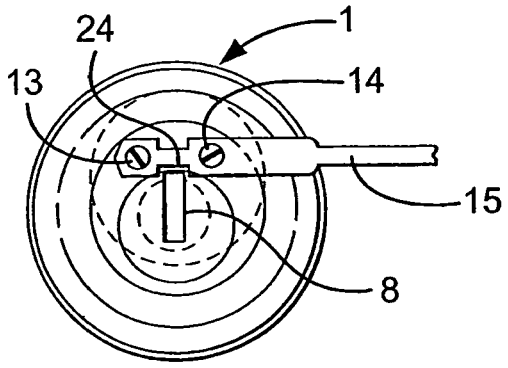
FIG. 1 is a front view of a first embodiment of a device in accordance with the present invention ready to receive a key.
Figure 2:
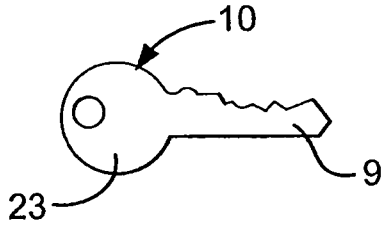
FIG. 2 is a side view of a key.
Figure 3:
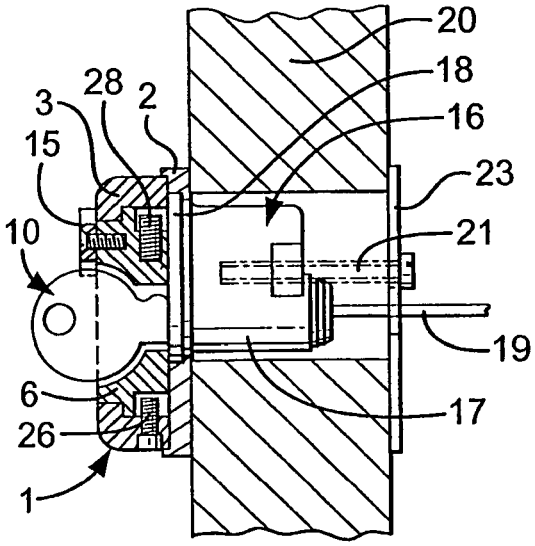
FIG. 3 is a side view, partly in section, of the device shown in FIG. 1 mounted on a conventional cylinder lock with the key inserted therein.
Figure 4:
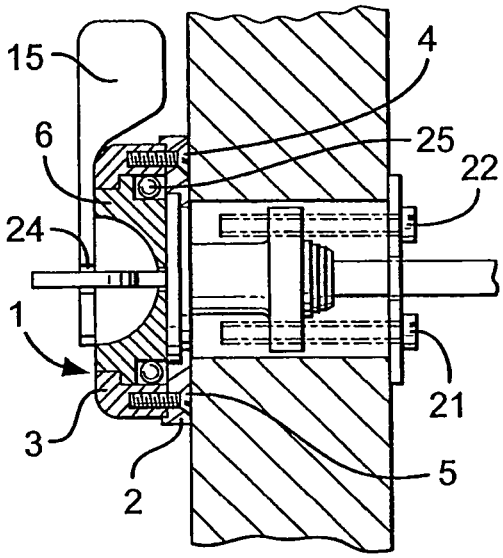
FIG. 4 is an underneath plan view, partly in section, of the arrangement shown in FIG. 3.
Figure 5:
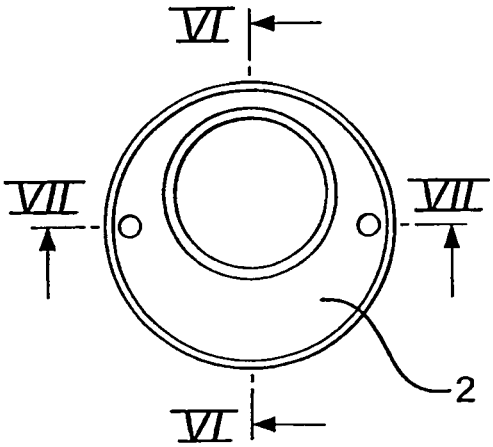
FIG. 5 is a front view of a backing plate which forms part of the device shown in FIG. 1.
Figure 6:
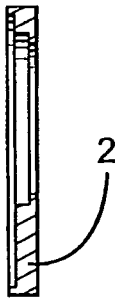
FIG. 6 is a section on line VI—VI of FIG. 5.
Figure 7:
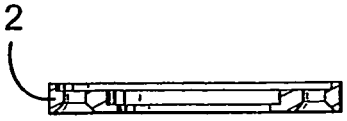
FIG. 7 is a section on line VII—VII of FIG. 5.

Referring to FIGS. 1 to 3 of the drawings there is shown a device which is generally identified by the reference numeral 1. The device 1 comprises a backing plate 2 on which is mounted a cover 3. The cover 3 is secured to the backing plate 2 by two screws 4 and 5 (FIG. 4).

The space between the cover 3 and the backing plate 2 accommodates a rotatable guide 6.

Figure 8:
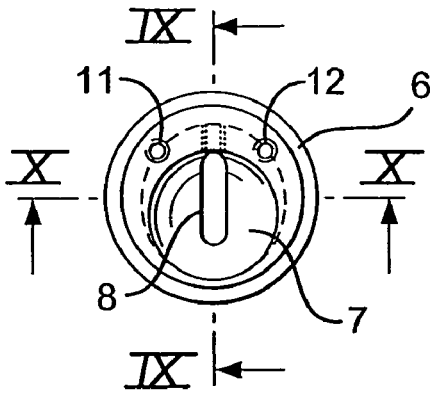
FIG. 8 is a front view of a rotatable guide which forms part of the device shown in FIG. 1.
Figure 9:
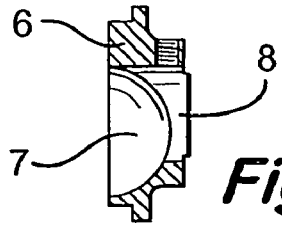
FIG. 9 is a section taken on line IX—IX of FIG. 8.
Figure 10:
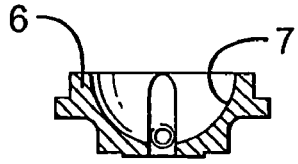
FIG. 10 is a section taken on line X—X of FIG. 8.
Figure 11:
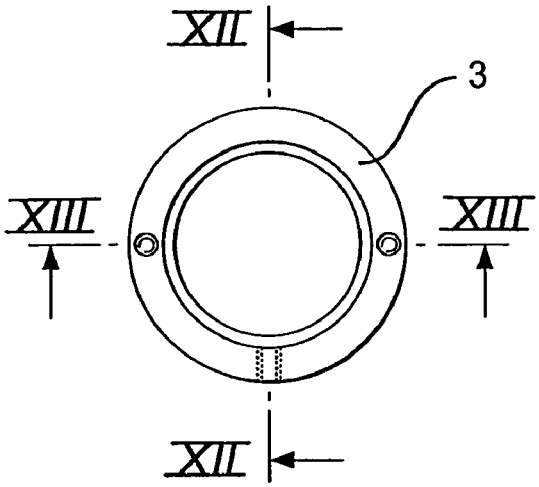
FIG. 11 is a rear view of a cover which forms part of the device shown in FIG. 1.
Figure 12:
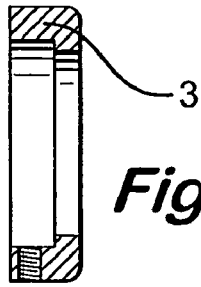
FIG. 12 is a section taken on line XII—XII of FIG. 11.
Figure 13:
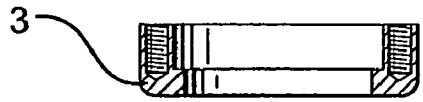
FIG. 13 is a section taken on line XIII—XIII of FIG. 11.

As can be better seen in FIGS. 8, 9 and 10, the rotatable guide 6 has a concave cavity 7 which is provided with a slot 8 which is intended to accommodate the shank 9 of a key 10.

The rotatable guide 6 is also provided with two threaded holes 11 and 12 which accommodate respective bolts 13 and 14 whereby a reversible handle 15 can be mounted on the rotatable guide 6.

A coil spring 25 is provided to bias the rotatable guide 6 to a starting position in which the slot 8 is normally substantially vertical.

Typically, a cylinder latch, such as the cylinder latch 16 shown in FIG. 3 comprises a body 17 having a face plate 18 and a tongue 19. The face plate 18 is supported by an annular ring which bears on the frame 20 of the door and the body is held in position by tightening two bolts 21 and 22 which act between a plate 23 and the body 17.

In the arrangement shown in FIG. 3 the annular ring is replaced by the backing plate 2 which is rotated until the slot 8 is aligned with the key receiving slot in the cylinder latch 16. This is typically vertical. The backing plate is then held in position by sufficiently tightening the bolts 21 and 22.

The device 1 is then ready for use. In particular, the key 10 is guided by the concave cavity 7 and the slot 8 of the rotatable guide 6 into the key receiving slot of the cylinder latch 16.

When the key 10 is fully inserted the head 23 of the key 10 lies in a recess 24 in the reversible handle 15. When the reversible handle 15 is depressed the rotatable 30 guide 6 rotates with respect to the cover 3 and the backing plate 2. The key 10 also rotates as a result of the side of the recess 24 in the reversible handle 15 engaging against the head 23 of the key 10.

After the door has been opened the reversible handle 15 is returned to its initial (horizontal) position and the slot 8 to its initial (vertical) position by the coil spring 25 as will hereinafter be described. In this connection it should be understood that the key receiving slot of the cylinder latch will also have been returned to its initial (vertical) position by the action of the internal latch mechanism (not shown) acting on the tongue 19.

Figure 14:
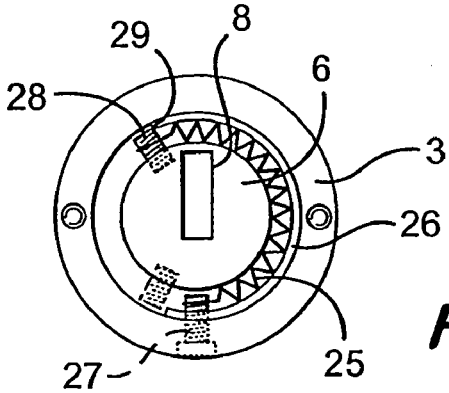
FIG. 14 is a rear view of the cover and rotatable guide of the device shown in FIG. 1.

As indicated previously, the rotatable guide 6 is biased to an initial position by the coil spring 25. In particular, as shown in FIG. 14, a band 26 of metal which subtends an angle of approximate 130° is secured to the cover 3 by a bolt 27 part of which extends inwardly of the cover 3 and forms a post to which one end of the coil spring 25 is attached. The other end of the coil spring 25 is secured to a bolt 28 which is screwed into the rotatable guide 6. In use the action of the coil spring 25 rotates the rotatable guide until the bolt 28 engages the free extremity 29 of the band 26. In this position the slot 8 is vertical and the reversible handle horizontal. When the reversible handle 15 is rotated the rotatable guide 6 rotates until the bolt 28 engages the other end of the band 26.

If desired the reversible handle 15 could be removed and replaced so that the reversible handle 15 projects to the left (as viewed in FIG. 1). At the same time the band 26 would be removed and its position reversed so that it extended clockwise around the cover 3 rather than counter-clockwise as shown. The coil spring 25 would also be moved to the opposite side of the rotatable guide 6.

Figure 15:
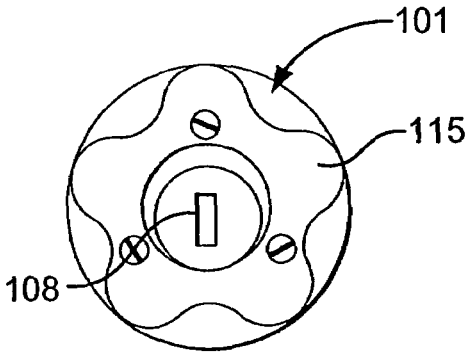
FIG. 15 is a front view of a second embodiment of a device in accordance with the present invention.
Figure 16:
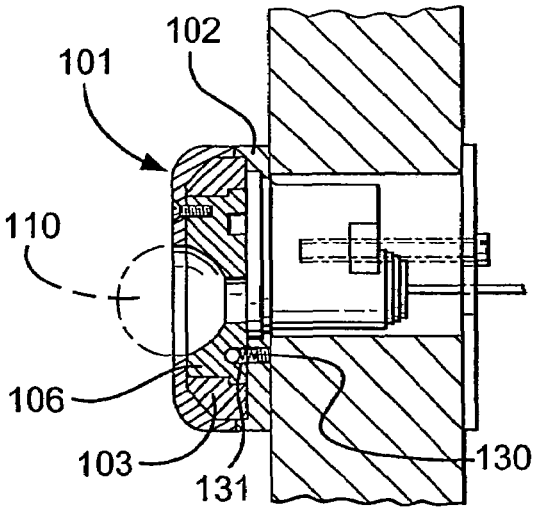
FIG. 16 is a side view, partly in section, of the device shown in FIG. 15 mounted on a conventional cylinder lock with the key inserted therein.
Figure 17:
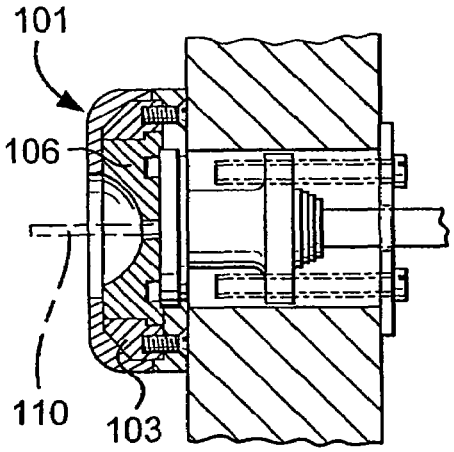
FIG. 17 is an underneath plan view, partly in section, of the arrangement shown in FIG. 16.

Referring now to FIGS. 15 to 17, there is shown a second embodiment of a device in accordance with the present invention which is generally identified by the reference numeral 101. The device shown in FIGS. 15 to 17 is generally similar to the device shown in FIGS. 1 to 14 and parts having similar functions have been identified by the same reference numerals but in the '100' series.

The main difference is that the reversible handle 15 has been replace with a knob 115 having a tortuous perimeter to facilitate the gripping thereof. The diameter of the knob 115 is approximately the same as the diameter of the backing plate 102. Although this embodiment does not provide as much leverage as the reversible handle 15 it can be used in more confined situations and is less susceptible to being damaged by vandals. In addition the knob 15 can be rotated as many times as desired. This is particularly useful if the device 101 is to be used with certain types of deadbolt latches which require two full turns to advance the bolt and then move an abutment into position to inhibit the latch being urged back into the lock by, for example a crowbar or other housebreaking implement. It will be appreciated that with this arrangement there is no mechanism for automatically biasing the rotatable guide 106 to a position where the slot 108 is exactly aligned with the key receiving slot of the cylinder latch. However, a spring loaded detent 130 may be provided which is arranged to enter an appropriately positioned recess 131 in the back of the rotatable guide 106 to enable the desired alignment to be felt. It will be understood that the action of the spring loaded detent 130 does not prevent the knob 115 being rotated but merely enables the knob 115 to be conveniently indexed.

Figure 19:
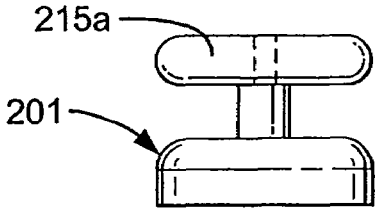
FIG. 19 is an underneath plan view of the device shown in FIG. 18.
Figure 18:
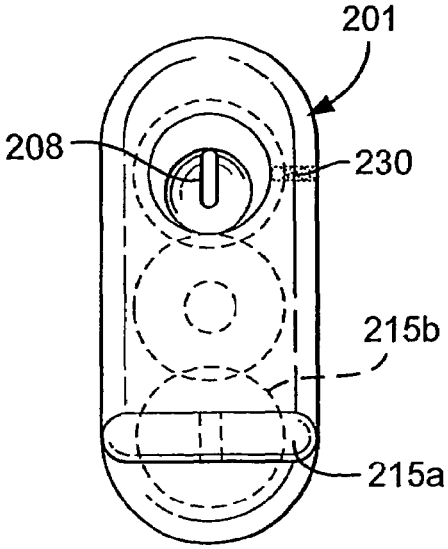
FIG. 18 is a front view of a third embodiment of a device in accordance with the present invention.
Figure 20:
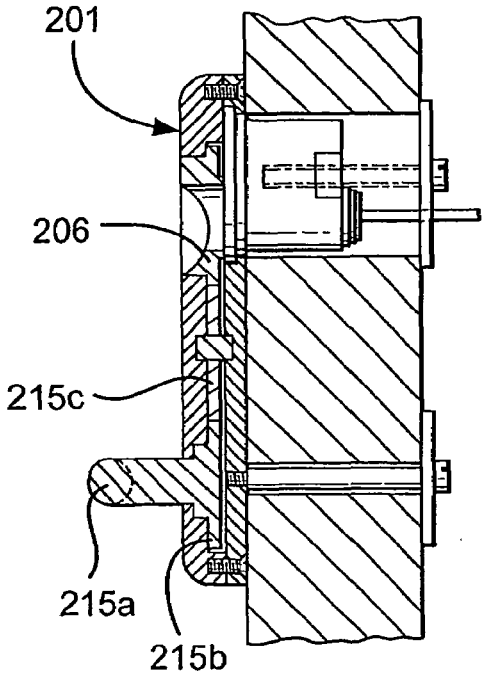
FIG. 20 is a side view, partly in section, of the device shown in FIG. 18.

Referring now to FIGS. 18 to 20, there is shown a third embodiment of a device in accordance with the present invention. The device, which is generally identified by reference numeral 201, is similar to the device shown in FIGS. 1 to 14 except that the reversible handle 15 has been replace by a gear train comprising a handle 215*a* which is connected to a friction wheel 215*b*, and an idler wheel 215*c* which engages the outer surface of the rotatable guide 206.

In use, after the key has been inserted in the cylinder lock the knob 215*a* is rotated. The relative sizes of the friction wheel 215*b* and the idler wheel 215*c* can be varied to adjust the mechanical advantage desired. Other parts having similar functions to parts shown in FIGS. 1 to 14 have been identified by similar reference numerals in the '200' series. As with the embodiment shown in FIGS. 15 to 17, there is no mechanism for automatically biasing the rotatable guide 206 to a position where the slot 208 is exactly aligned with the key receiving slot of the cylinder latch. However, a spring loaded detent 230 is provided which co-opereates with a recess in the rotatable guide 206 in a manner similar to that described with reference to the embodiment shown in FIGS. 15 to 17.

Figure 21:
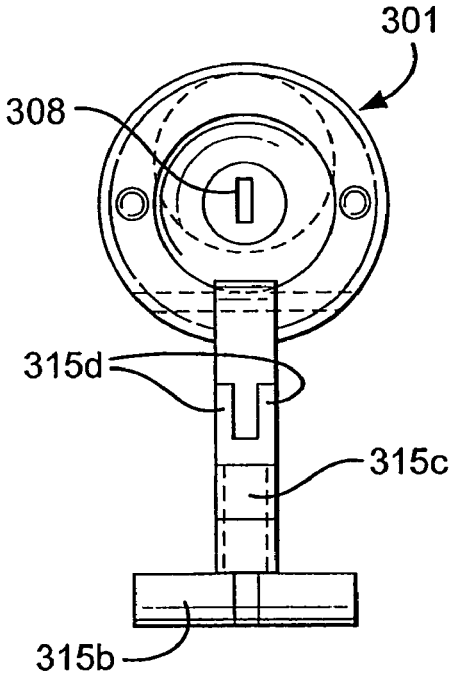
FIG. 21 is a front view of a fourth embodiment of a device in accordance with the present invention.
Figure 22:
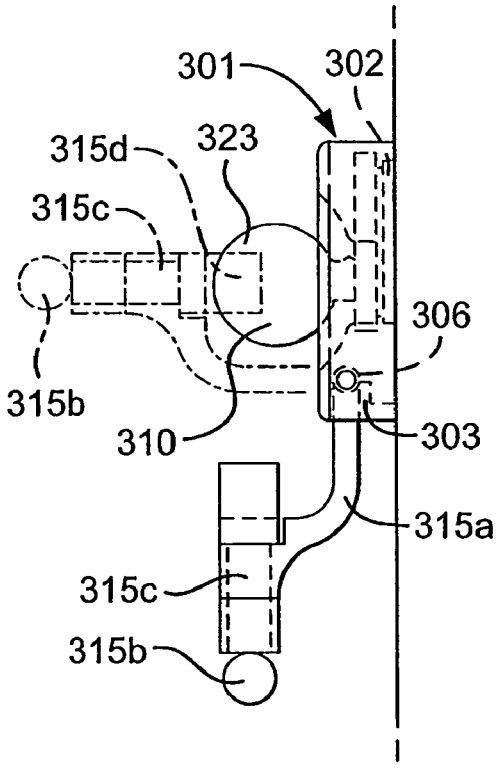
FIG. 22 is a side view of the device shown in FIG. 21.

Referring now to FIGS. 21 and 22 there is shown a fourth embodiment of a device in accordance with the present invention.

The device, which is generally identified by reference numeral 301 is generally similar to the device shown in FIGS. 1 to 14 and parts having similar functions have been identified by similar reference numerals in the '300' series.

The device differs form that shown in FIGS. 1 to 14 in that the rotatable guide 306 is provided with a frame 315*a* which is pivotally mounted thereto and which can be pivoted from an inoperative, hanging position (FIG. 21) to an operative, horizontal position (shown in chain-dotted lines in FIG. 22). A handle 315*b* is attached to one end of a shaft 315*c* which is non-rotatably mounted in the frame 315*a* and has a bifurcated end 315*d* the sides of which, in the operative position of the frame 315*a* lie to either side of the head of the key 310 which has been placed in the cylinder latch.

In use, after the key 310 has been inserted through the slot in the concave cavity of the rotatable guide the handle 315*b* is swung upwardly until the head 323 of the key 310 lies between the sides of the bifurcated end 315*d* of the shaft 315*c*. The handle 315*b* is then turned so that the rotatable guide 306 and the key 310 turn to open the lock.

When the handle 315*b* is released it swings downward to the position shown in FIG. 21. The pendulum effect of the handle 315*b* helps ensure that the slot 308 returns to a vertical position in alignment with the key receiving slot on the cylinder latch.

Figure 23:
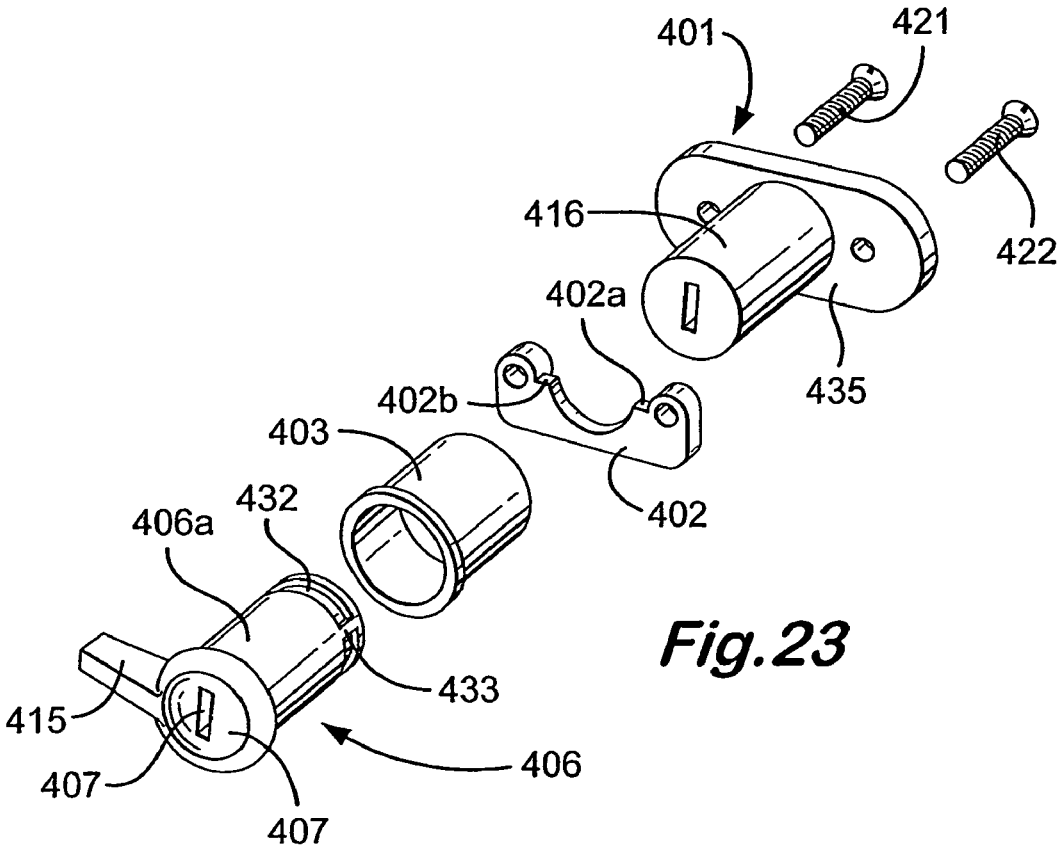
FIG. 23 is an exploded perspective view of a fifth embodiment of a device in accordance with the present invention.
Figure 25:
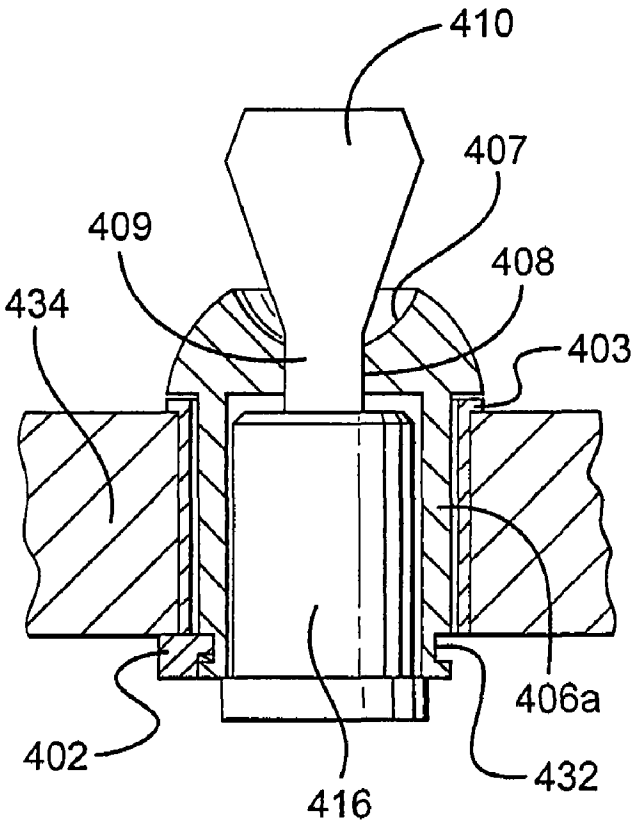
FIG. 25 is view taken on line XXV—XXV of FIG. 24.

Referring to FIG. 23 there is shown a device which is generally identified by reference numeral 401. The device 401 is primarily intended for use with locks on office and domestic furniture, for example with locks on the doors of cupboards or the drawers of desks and filing cabinets. Such locks can be fitted in the doors or drawers or in the carcasses therefor.

The device 401 comprises a backing plate 402, a bush 403 and a rotatable guide 406. The rotatable guide 406 comprises a cylindrical section 406*a* one end of which is provided with a handle 415 part of which has a concave cavity 407 which is provided with a slot 408 which is intended to accommodate the shaft 409 of a key 410.

The other end of the cylindrical section 406*a* is provided with a circumferentially extending groove 432. A lug 433 extends across part of the circumferentially extending groove 432 as shown and serves to limit rotational movement of the handle 415 as will be explained hereinafter.

By way of example it will be assumed that it is desired to provide the door of an office cabinet with a lock.

Figure 24:
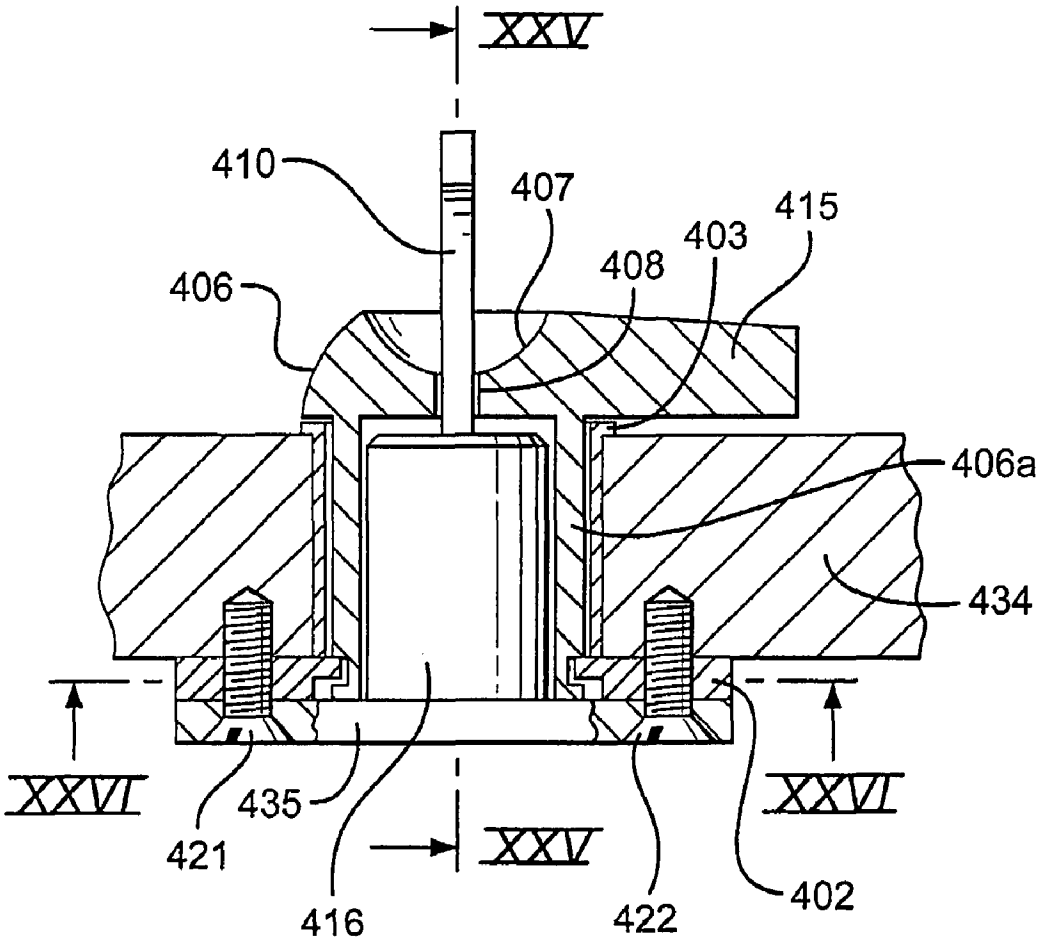
FIG. 24 is a simplified cross-section showing the device of FIG. 23 in use with a key inserted in the lock.
Figure 26:
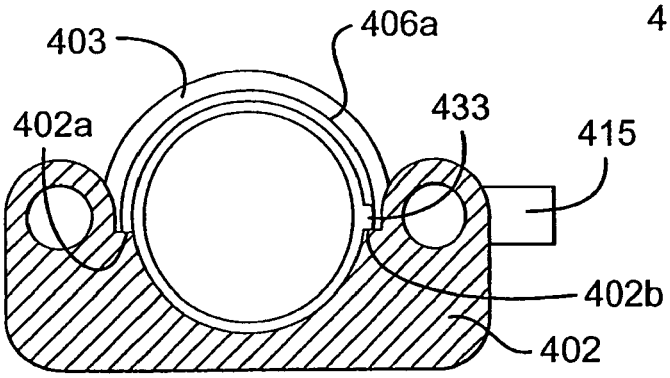
FIG. 26 is a section taken on line XXVI—XXVI of FIG. 24.
Figure 27:
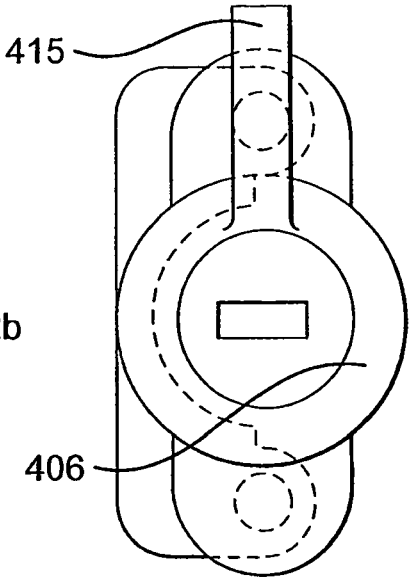
FIG. 27 is a front elevation of the device shown in FIG. 23.

Firstly, a hole is drilled through through door 434 (FIG. 24). The bush 403 is then pressed into the hole. The cylindrical portion 406*a* of the rotatable guide 406 is then slid into bush 403 until the circumferentially extending groove 432 projects beyond the end of the bush 403. The backing plate 402 is then slid along the rear surface of the door 434 until part of it enters the circumferentially extending groove 432.

The lock 416 is then slidably inserted into the cylindrical section 406*a* of the rotatable guide 406 and secured in place by screws 421 and 422 which pass through a flange 435 on the lock 416 and through holes in the backing plate 402 before entering the door 434.

The handle 415 can be rotated through 180° from a first position where the handle 415 extends horizontally to the left of the bush 403 with the slot 408 vertical to a second position (as shown) where the handle 415 extends horizontally to the right of the bush 403 and the slot 408 is again vertical (but rotated through 180° with respect to its orientation when the handle 415 was in its first position). Rotation of the handle 415 is limited by engagement of the lug 433 on the backing plate 402. The projection of the backing plate 402 into the circumferentially extending groove 432 also serves to prevent the handle 415 being removed.

For the purposes of illustration it will be assumed that the door is locked and the handle is in the position shown in FIG. 23.

The user first advances the key 410 toward the lock 416. The shank 409 of the key 410 enters the concave cavity 407 which facilitates the entry of the shank into the lock 416.

Once the key 410 is fully inserted the user rotates the handle 415 through 180° anti-clockwise which rotates the key through 180° anti-clockwise and opens the lock 416. It should perhaps be mentioned that the lock 416 is of a conventional office furniture type where the slot moves through 180° when moving from the locked to the open position and vice-versa.

Figure 28:
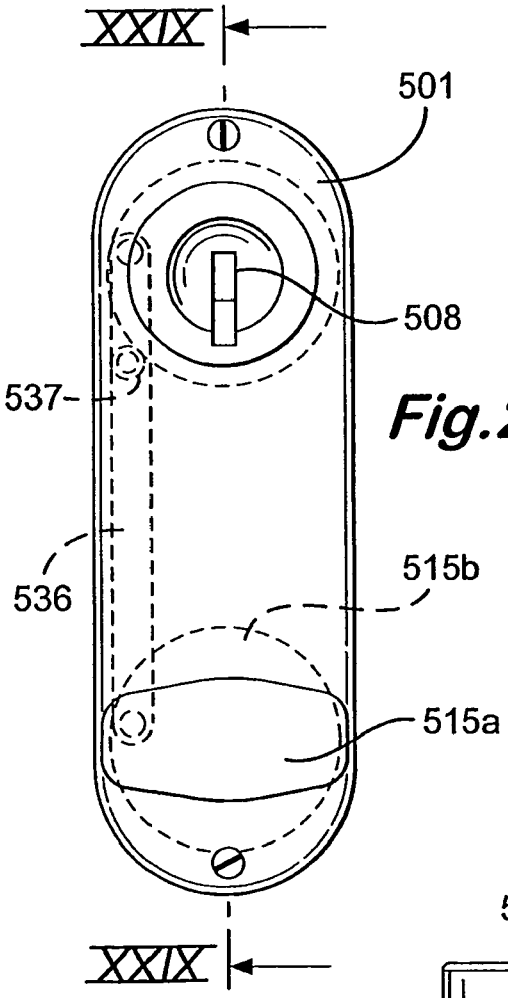
FIG. 28 is a front elevation of a sixth embodiment of a device in accordance with the present invention.
Figure 29:
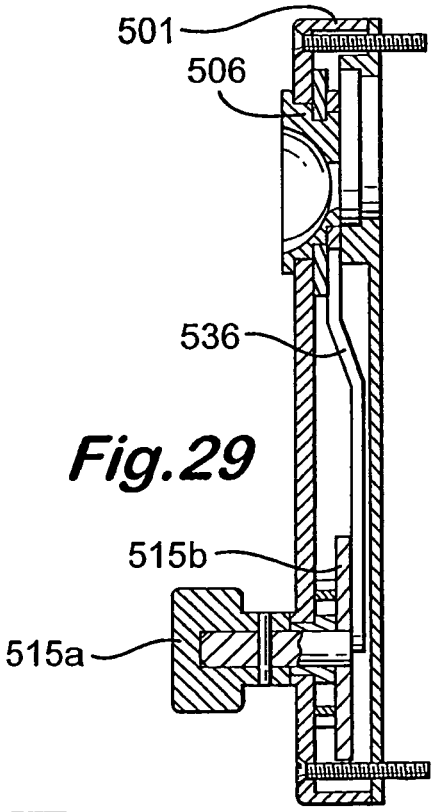
FIG. 29 is a section taken on line XXIX—XXIX of FIG. 28.
Figure 30:
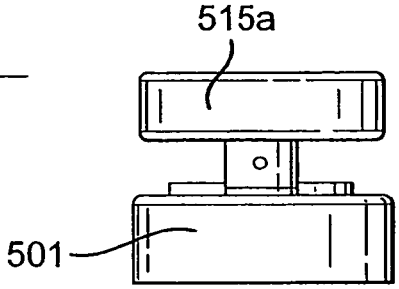
FIG. 30 is a bottom plan view of the device shown in FIG. 28.

Referring now to FIGS. 28 to 30 there is shown a device which is generally identified by the reference numeral 501. The device 501 is generally similar to the device shown in FIGS. 18 to 20 and parts having similar functions have been identified by the same reference numerals but in the '500' series. The main difference is that the intermediate wheel 215*c* has been replace by a connecting rod 536 which transfers rotational movement of the handle 515*a* to the rotatable guide 506. A stop pin 537 is mounted on the connecting rod 536 and serves to limit the rotational movement of the rotatable guide 506 on engagement therewith.

Figure 31:
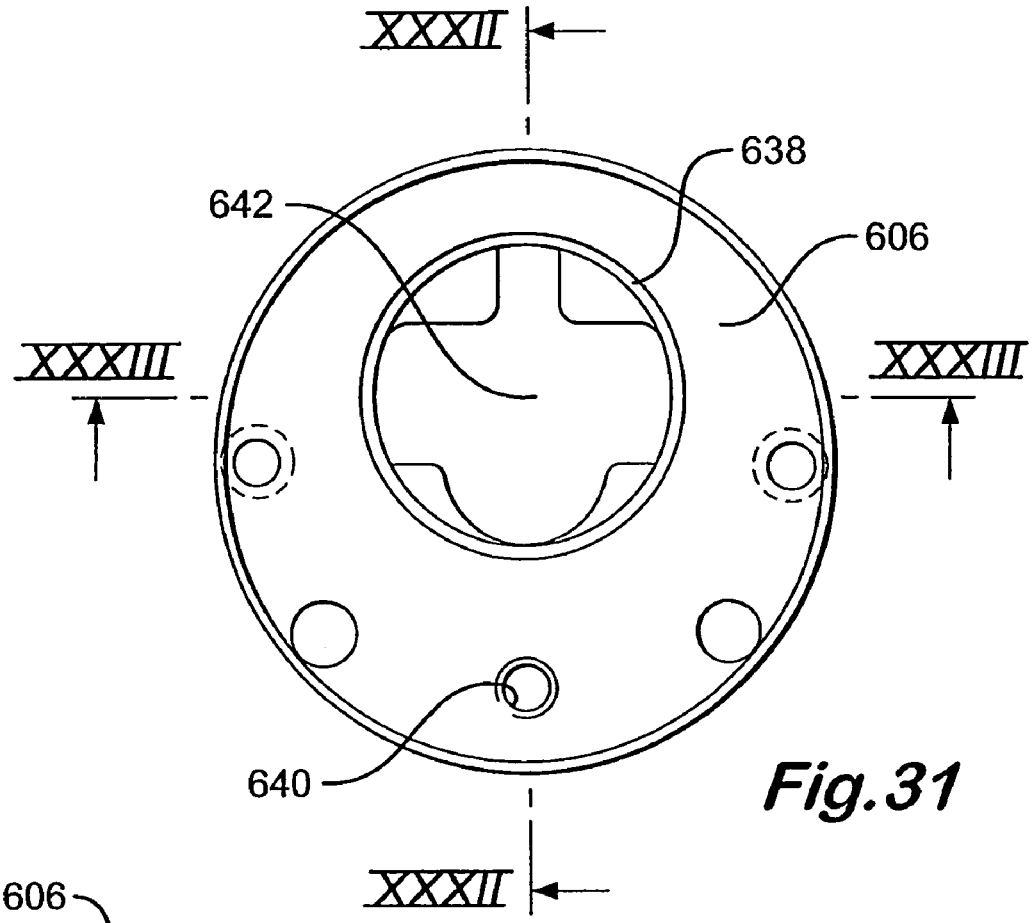
FIG. 31 is a plan view of part of a seventh embodiment of a device according to the present invention.
Figure 32:
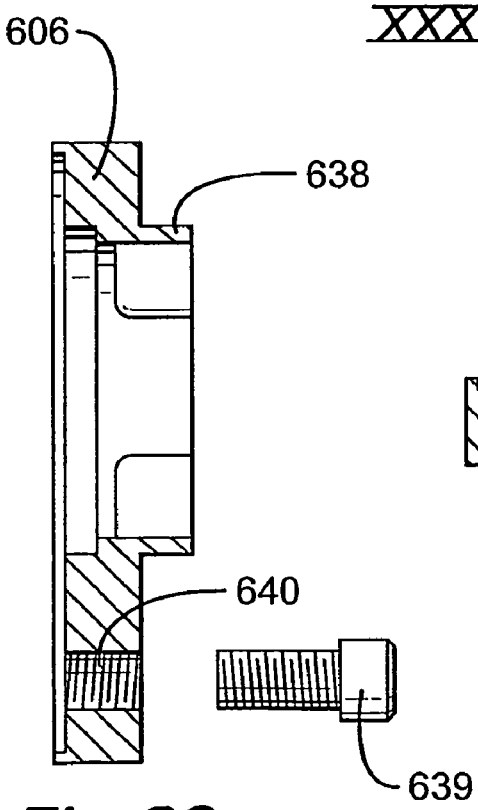
FIG. 32 is a section taken on line XXXII—XXXII of FIG. 31.
Figure 33:
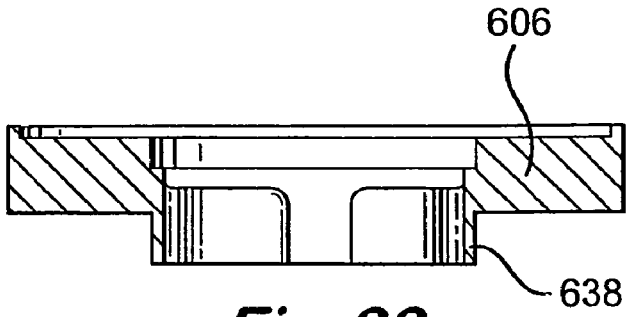
FIG. 33 is a section taken on line XXXIII—XXXIII of FIG. 31.

FIGS. 31 to 33 show a backing plate 606 which differs from the backing plates previously described in that it is provided with a tubular stub 638 which, in use, extends into the hole cut through the door. The tubular stub 638 helps prevent the device being broken off the door by vandals or burglars. This embodiment is also provided with a threaded security pin 639 which threadely engages in a threaded hole 640 in the backing plate 606 and, in use, extends into a bore drilled into the door. The backing plate 606 is provided with a shaped aperture 642 designed to support a standard 'ERA' cylinder lock.

Various modifications to the embodiments described are envisaged. For example, the coil spring 25 could be replaced by a torsional spring. The recess may be provided with a slot which, in use, engages the side of a key inserted in the lock. In this way, rotational forces applied to the rotatable guide act on the side of the head of the key rather than the shank.

Figure 34:
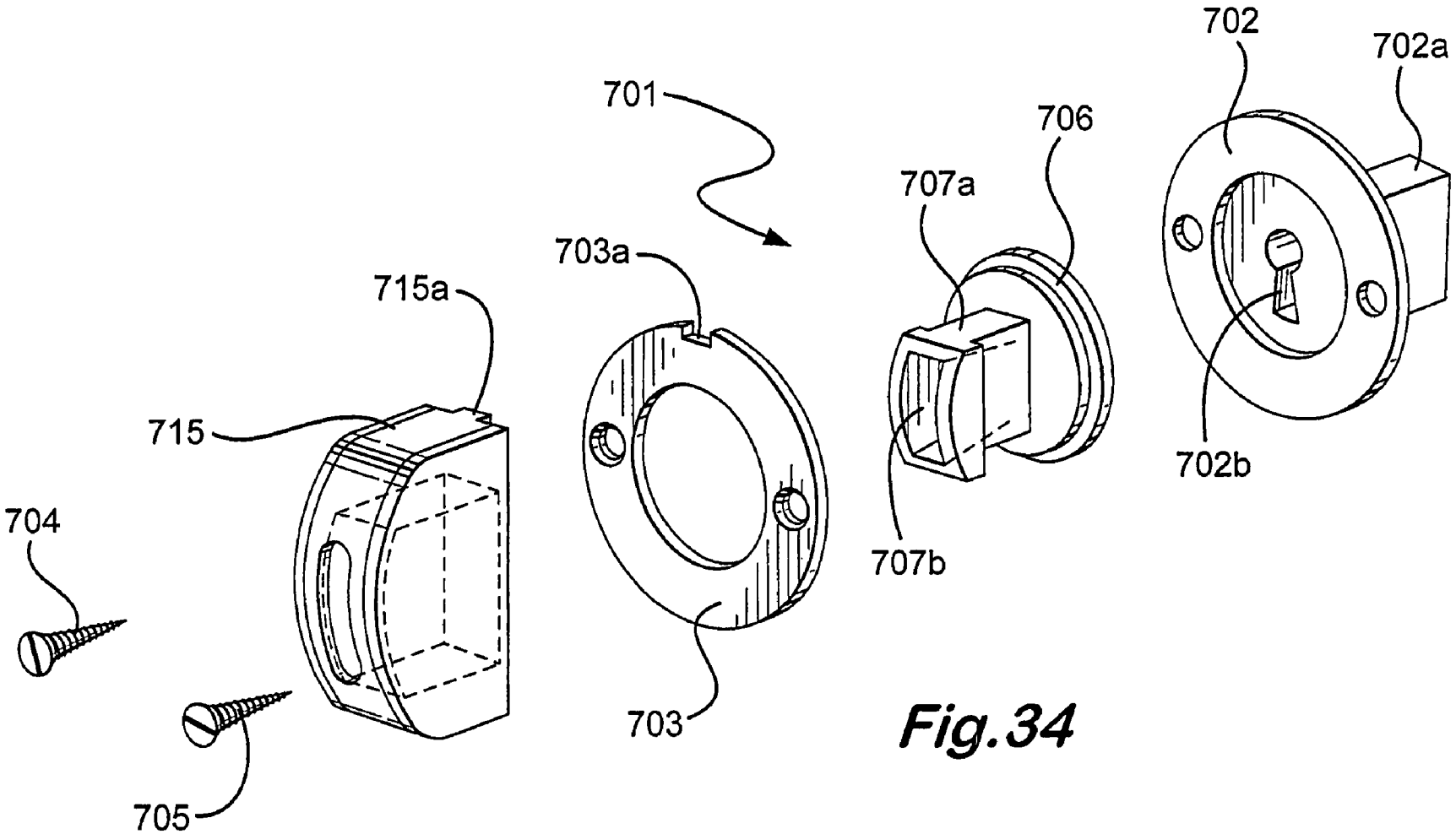
FIG. 34 is an exploded view of an eighth embodiment of a device according to the present invention.
Figure 35:
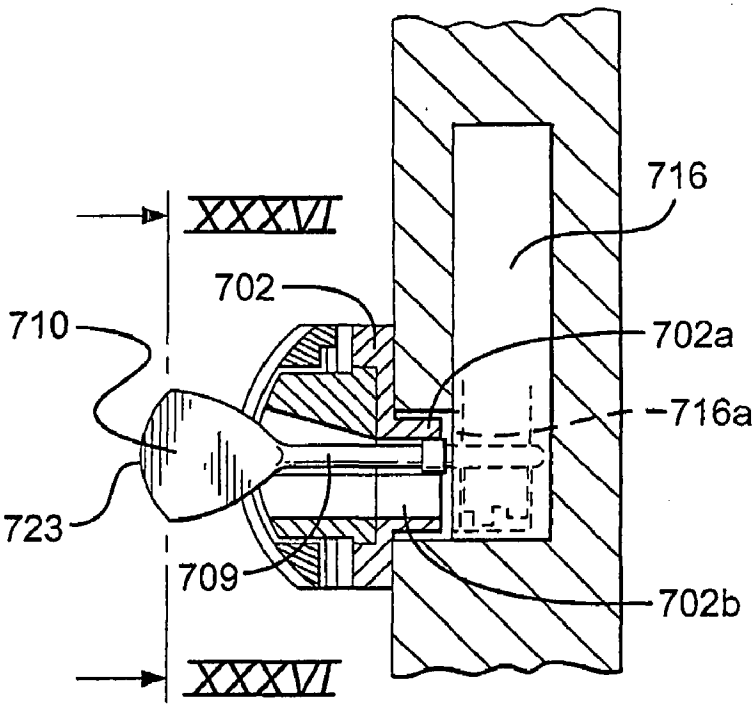
FIG. 35 is a vertical section showing the device shown in FIG. 34 mounted on a door with a key grip in a first position and with a key inserted.
Figure 36:
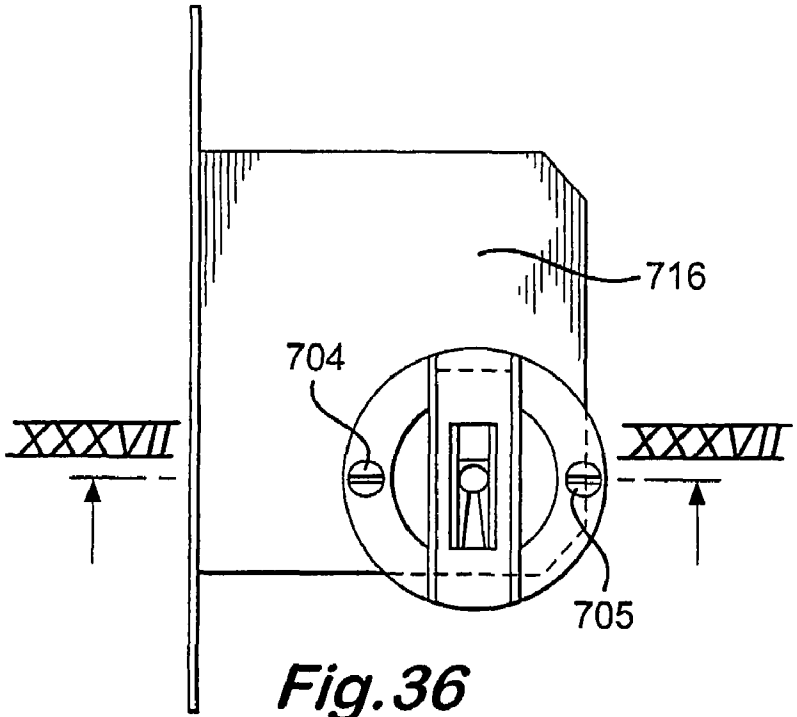
FIG. 36 is a view looking in the direction of the arrows XXXVI—XXXVI of FIG. 35 but with the key removed.

Referring now to FIGS. 34 to 36 there is shown an eighth embodiment of a device in accordance with the present invention.

The device, which is generally identified by the reference numeral 701, comprises a backing plate 702 which is provided with an extension 702*a* which extends rearwardly of the backing plate 702 and is provided with a passage 702*b* of substantially constant key-hole cross section for allowing the passage therethrough of a key 710 for a mortice lock 716 (FIG. 35).

A retaining cover 703 is secured to the backing plate 702 by two screws 704 and 705.

The space between the retaining cover 703 and the backing plate 702 accommodates a rotatable guide 706.

The rotatable guide 706 is provided with a projection 707*a* which extends forwardly from the rotatable guide 706 and defines a tapered cavity 707*b* which is intended to facilitate the insertion of a key 710 into the passage 702*b* and thence into the mortice lock 716.

Figure 37:
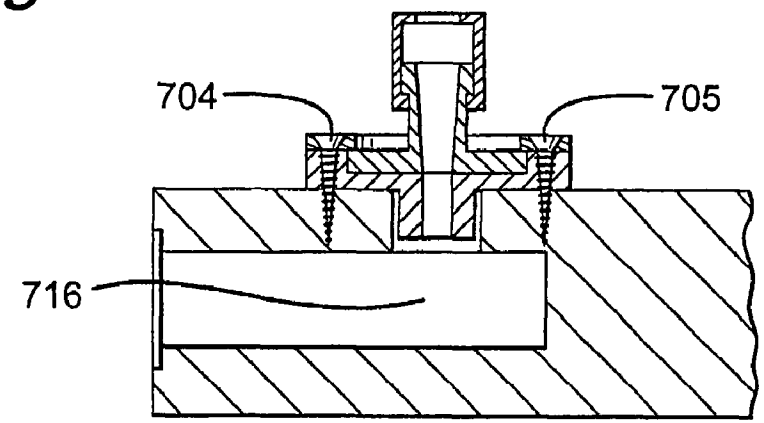
FIG. 37 is a view taken on line XXXVII—XXXVII of FIG. 36 with the key grip in a second position.

A handle 715 is mounted on the rotatable guide 706 and, although it cannot be rotated relative to the rotatable guide 706, can be moved axially relative thereto between a first (retracted) position (FIG. 35) and a second(extended) position (FIG. 37).

In order to use the device 701 shown in FIGS. 35 to 37, the user first gently presses the handle 715 toward the door and rotates it until a tongue 715*a* on the handle 715 enters a slot 703*a* on the cover 703. In this position the tapered cavity 707*b* extends vertically and is aligned with the passage 702*b* and the key hole 716*a* in the mortice lock 716.

As the key 710 is inserted the sides of the tapered cavity 707*b* facilitate the proper orientation of the key 710. When fully inserted, the head 723 of the key 710 lies outside the confines of the handle 715 (FIG. 35).

The handle 715 is then pulled outwardly to its second (extended) position (FIG. 37). In this position the head 723 of the key 710 lies within the confines of the handle 715.

Rotation of the handle 715 results in rotation of the projection 707*a* (which is not rotatable relative to the handle 715) and rotation of the key 710 (via the engagement of its head 723 to operate the mortice lock 716.

In order to remove the key 710, the handle 715 is rotated until the tongue 715*a* is aligned with the slot 703*a* at which position the handle 715 can be pushed fully home towards the door and the key 710 can be withdrawn from the mortice lock 716.

Figure 38:
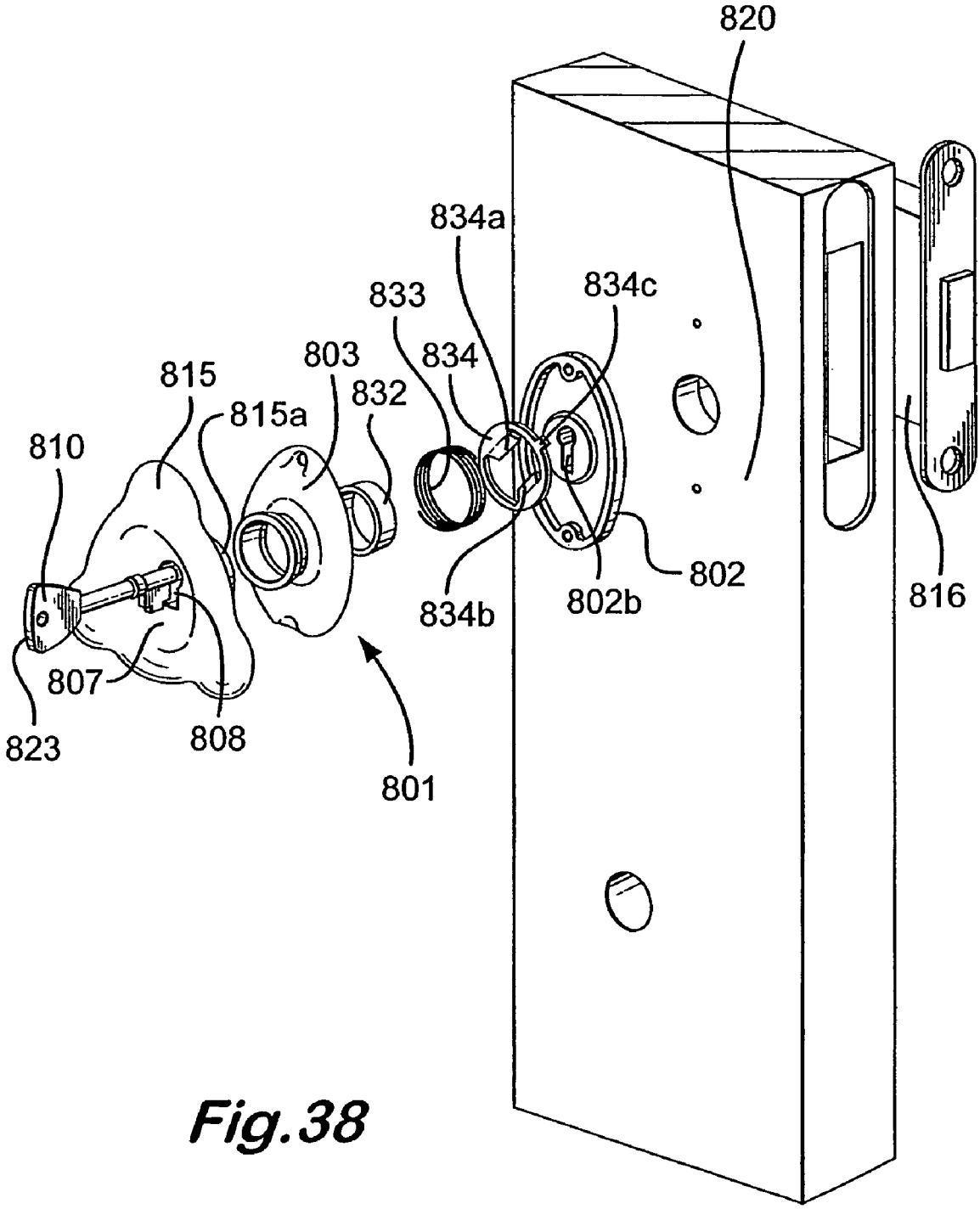
FIG. 38 is an exploded perspective view of a ninth embodiment of a device in accordance with the present invention.

Referring now to FIG. 38 there is shown a device which is generally identified by the reference numeral 801.

The device 801 comprises a backing plate 802 which, like the backing plate 702 shown in FIG. 34, is provided with an extension (not visible) which extends rearwardly of the backing plate 702 and is provided with a passage 802*b* of substantially constant key-hole cross section for allowing the passage therethrough of a key 810 for a mortice lock 816.

A retainer cover 803 can be secured to the backing plate 802 by two screws (not shown).

The space between the retainer cover 803 and the backing plate 802 accommodates a spacer 832, a compression spring 833 and a spring plate 834. The compression spring, which has a greater internal diameter than the external diameter of the spring plate 834, acts between the backing plate 802 and the handle 815 to bias the handle 815 away from the frame 820 of a door. The handle 815, which can move axially into and out of the retainer cover 803, is provided with a concave cavity 807 provided with a slot 808.

In use, the user inserts the key into the concave cavity 807 which facilitates entry of the key 810 into the slot 808.

As will be explained in greater detail hereinafter the slot 808 is aligned with the passage 802*b*. Accordingly, the key 810 can pass into the mortice lock 816. When fully home the majority of the head 823 of the key 810 lies inside the slot 808. Rotation of the handle 815 causes rotation of the key 810 which, in turn, throws the bolt of the mortice lock 816. Typically, the key 810 will be rotated through 360° in one sense to extend the bolt of the mortice lock 816 and 360° in the opposite sense to retract the bolt.

In order to remove the key 810 the user simply presses the knob 815 toward the frame 820 which exposes the head 823 of the key 810 to facilitate withdraw thereof.

The spring plate 834 interacts with the handle 815 and the backing plate 802 to facilitate alignment of the slot 808 and the passage 802*b* to insert and withdraw the key 810. In particular, the spring plate 834 is provided with two leaves 834*a* and 834*b* which project toward the backing plate 802 and define a generally rectangular opening through which the hub 815*a* extends. The spring plate 834 prevents the handle 815 being withdrawn from the retainer cover 803. However, in addition, the spring plate 834 is provided with a small upstand 834*c* and the side of the retainer cover 803 facing the frame 820 is provided with a circular hub having a single indentation therein facing the retainer cover 803. As the handle 815 is rotated the upstand 834*b* rides on the circular hub. When the upstand 834*c* enters the single indentation this can be felt and acts as an indexing mechanism signifying that the slot 808 and the passage 802*b* are in alignment. Depending on the height of the upstand 834*b* and the construction of the spring plate 834 this indexing feature might only be felt when the handle 815 is pushed inwardly towards the frame 820.

Figure 39:
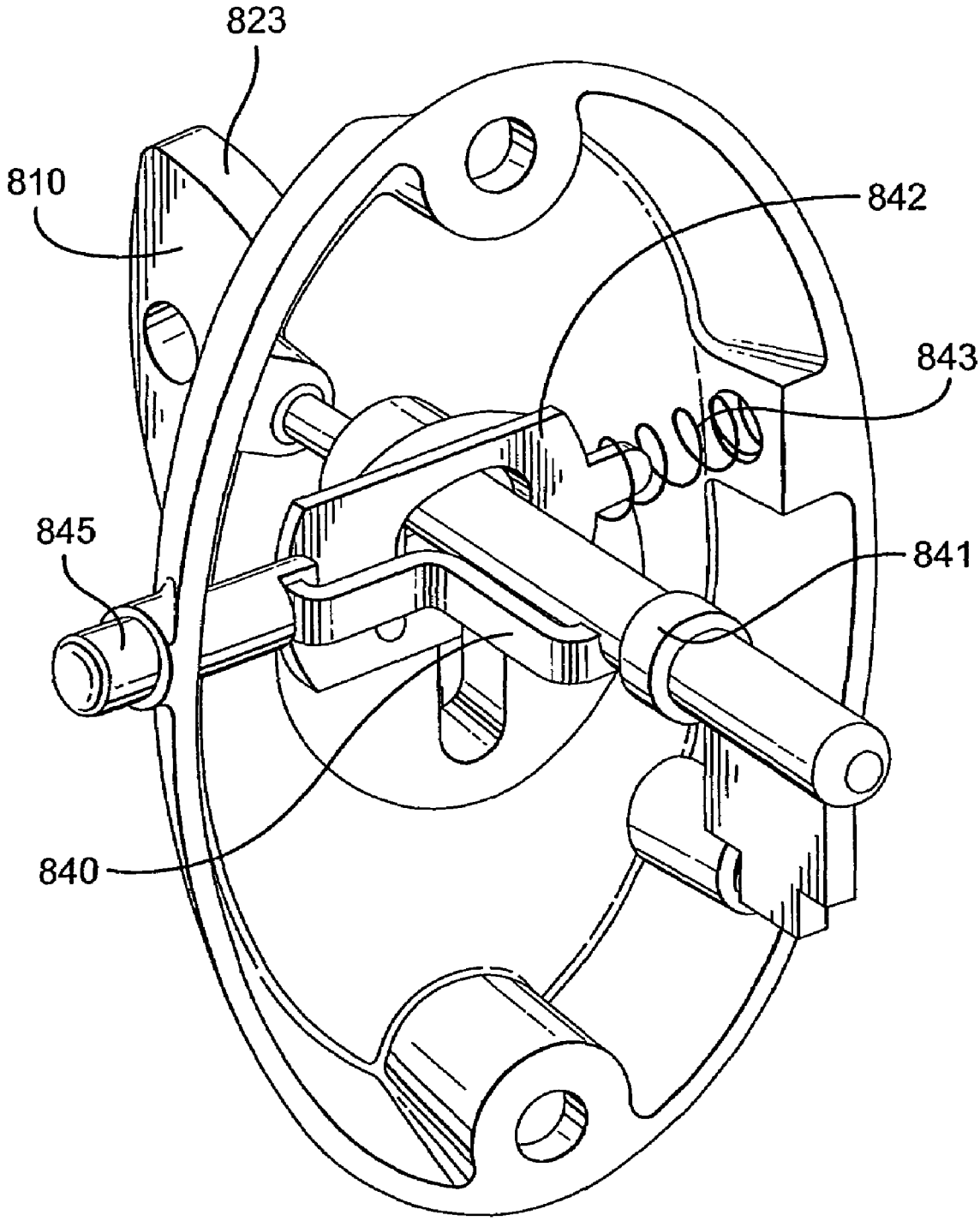
FIG. 39 is a view of part of the device shown in FIG. 38 provided with a modification to inhibit a key being dislodged.

Turning now to FIG. 39 a modification is shown for preventing the key 810 being pushed out of the mortice lock by a person who has access to the other side of the mortice lock. The modification comprises an arm 840 which, in its operative position, sits between the head 823 of the key 810 and the collar 841 provided on conventional mortice keys. The arm 840 is mounted on a plate 842 which can slide perpendicular to the longitudinal axis of the key 810 and is biased to an open position by a spring 843. A plunger 845 can be depressed a first time to displace and hold the arm 840 in its locking position. When pressed a second time the plunger allows the arm 840 to be moved to its inoperative position by the spring 843. In principle, the operation of the mechanism is similar to that use in a retractable ball point pen.

It should be noted that this embodiment does not have the indexing feature of the embodiment shown in FIG. 38.

The invention claimed is:

1. A device for opening a locked door or drawer, which device comprises;

a) means for facilitating the insertion of a key into a lock, said means comprising a rotatable guide having a slot for accommodating the shank of a key and facilitating the entry of said key into a lock, said rotatable guide being rotatable independently of said lock in the absence of a key;

b) means for rotating said key when inserted; and c) alignment means which, in use, will either return said slot to a position in which it is aligned with said lock to facilitate insertion of a key therein or will index said slot in such a position.

2. A device as claimed in claim 1, wherein said rotatable guide comprises a concave cavity to facilitate the passage of a key to said slot.

3. A device as claimed in claim 1, wherein said alignment means includes means to bias said rotatable guide to a predetermined position.

4. A device as claimed in claim 3, wherein said alignment means comprises a spring.

5. A device as claimed in claim 4, further comprising a backing plate having an opening through which can pass the body of a cylinder latch but not the head thereof so that said device can be secured to a door via said cylinder latch.

6. A device as claimed in claim 5, further comprising a cover removeably mounted on said backing plate, and said rotatable guide is rotatably mounted between said backing plate and said cover.

7. A device as claimed in claim 1, including a handle displaceable to rotate said rotatable guide.

8. A device as claimed in claim 7, wherein said handle has a recess to accommodate at least part of the head of a key when inserted in a lock, whereby when said handle is depressed said rotatable guide rotates and said key also rotates as a result of the recess in the reversible handle engaging against the head of the key.

9. A device as claimed in claim 7, wherein said handle comprises an elongate member which can be attached to said rotatable guide in two positions, one extending to one side of said rotatable guide and the other to the other side of said rotatable guide.

10. A door fitted with a lock having a device as claimed in claim 1 operatively associated therewith.

11. A drawer fitted with a lock having a device as claimed in claim 1 operatively associated therewith.

12. A device as claimed in claim 2, wherein said slot is positioned at the bottom of said concave cavity and extends upwardly on one side thereof.

* * * * *